United States Patent [19]

Apps et al.

[11] Patent Number: 4,899,874

[45] Date of Patent: Feb. 13, 1990

[54] STACKABLE LOW DEPTH BOTTLE CASE

[75] Inventors: William P. Apps, Anaheim; James B. Rehrig, Rancho Palos Verde, both of Calif.

[73] Assignee: Rehrig-Pacific Company, Inc., Los Angeles, Calif.

[21] Appl. No.: 186,140

[22] Filed: Apr. 26, 1988

[51] Int. Cl.[4] ..... B65D 21/00

[52] U.S. Cl. ..... 206/201; 206/203; 206/427; 206/509; 206/511; 206/821

[58] Field of Search ..... 206/427, 509, 511, 203, 206/201, 821; 220/21, 22, 23.6

[56] References Cited

U.S. PATENT DOCUMENTS

| | | | |
|---|---|---|---|
| D. 147,981 | 11/1947 | Lehman . | |
| D. 195,702 | 7/1963 | Russo . | |
| D. 201,257 | 6/1965 | Vidal . | |
| D. 289,938 | 5/1987 | Warwick | 34/45 |
| 2,535,493 | 12/1950 | Gerber . | |
| 2,626,079 | 8/1953 | Keller . | |
| 2,743,030 | 4/1956 | Read, Jr. . | |
| 2,935,222 | 5/1960 | O'Connell | 220/21 |
| 2,970,715 | 2/1961 | Kappel et al. . | |
| 3,055,542 | 9/1962 | Russo . | |
| 3,151,762 | 10/1964 | Vidal . | |
| 3,247,996 | 4/1966 | Garcia . | |
| 3,333,729 | 8/1967 | Rabb . | |
| 3,349,943 | 10/1967 | Box | 220/21 |
| 3,376,998 | 4/1968 | Cornelius . | |
| 3,390,801 | 7/1968 | Adomat | 220/21 |
| 3,392,869 | 7/1968 | Needt . | |
| 3,812,996 | 5/1974 | Bunnell . | |
| 4,037,722 | 7/1977 | Bremer | 206/523 |
| 4,071,162 | 2/1975 | Steinlein et al. | 220/21 |
| 4,095,720 | 6/1978 | Delbrouck et al. . | |
| 4,101,049 | 7/1978 | Wallace et al. | 206/511 |
| 4,120,444 | 10/1978 | Gray | 206/511 |
| 4,162,738 | 7/1979 | Wright . | |
| 4,204,596 | 5/1980 | Davis | 206/203 |
| 4,319,685 | 3/1982 | David | 206/507 |
| 4,344,530 | 8/1982 | deLarosiere . | |
| 4,410,099 | 10/1983 | deLarosiere | 220/21 |
| 4,416,373 | 11/1983 | deLarosiere | 206/432 |
| 4,700,836 | 10/1987 | Hammett | 206/427 |
| 4,700,837 | 10/1987 | Hammett | 206/427 |
| 4,773,554 | 9/1988 | Warwick | 206/509 |
| 4,789,063 | 12/1988 | Hammett | 206/432 |

FOREIGN PATENT DOCUMENTS

| | | |
|---|---|---|
| 247904 | 8/1962 | Australia . |
| 680197 | 10/1966 | Belgium . |
| 693216 | of 1967 | Belgium . |
| 965056 | 3/1975 | Canada . |
| 0099827 | 2/1984 | European Pat. Off. . |
| 1207268 | 6/1966 | Fed. Rep. of Germany . |
| 1486412 | 4/1973 | Fed. Rep. of Germany . |
| 1285689 | 4/1961 | France . |
| 1518610 | 2/1968 | France . |
| 2401087 | 4/1983 | France . |
| WO82/01536 | 5/1982 | PCT Int'l Appl. . |
| 1032916 | 6/1966 | United Kingdom . |
| 1115343 | 5/1968 | United Kingdom . |
| 1120067 | 7/1968 | United Kingdom . |
| 1152038 | 5/1969 | United Kingdom . |
| 1312701 | 4/1970 | United Kingdom . |
| 1319726 | 6/1973 | United Kingdom . |
| 1330778 | 9/1973 | United Kingdom . |
| 2079256 | 1/1982 | United Kingdom . |
| 2158044 | 11/1985 | United Kingdom . |

*Primary Examiner*—Joseph Man-Fu Moy

*Attorney, Agent, or Firm*—Banner, Birch, McKie & Beckett

[57] ABSTRACT

The stackable low depth bottle case of the present invention includes four side walls and a bottom portion. A plurality of upwardly projecting hollow columns extend upwardly within the side walls. The columns, walls, and bottom portion define a plurality of bottle retaining pockets. The bottle retaining pockets have flat surfaces to permit retention of bottles without base indentations and to permit rotation of petaloid bottles. The columns extend upwardly from the base portion a distance approximately one third of the height of the bottles to be retained. The columns may be hollow to permit empty cases to stack top to bottom. The lower surface of the bottom portion has circular concave portions with central retaining openings to facilitate stacking of loaded cases top to bottom. When a case is disposed on a lower filled case, the bottle tops of the lower case are guided toward the central retaining openings by the circular concave portions.

59 Claims, 12 Drawing Sheets

STACKABLE LOW DEPTH BOTTLE CASE

TECHNICAL FIELD

The present invention relates to low depth stackable bottle cases for use in retaining and transporting bottles. More particularly, the present invention relates to beverage bottle cases that combine low depth with high stability for stored bottles.

BACKGROUND OF THE INVENTION

Plastic bottles are widely used as containers for retailing soft drinks and other beverages. One type of plastic, polyethylene terephthalate (PET), has become particularly popular because of its transparency, light weight, and low cost. In addition to being flexible, the walls of PET bottles are strong in tension and thus can safely contain the pressure of a carbonated beverage. Moreover, conventional PET bottles can bear surprisingly high compressive loads, provided that the load is directed substantially along an axially symmetric axis of the bottle. A single PET bottle can support the weight of many bottles of the same size filled with beverage if the bottle is standing upright on a flat, horizontal surface and the weight of the other bottles is applied to the closure of the single bottle and is directed substantially vertically along the symmetric axis. However, if a compressive load is applied to a conventional PET beverage bottle along a direction other than the symmetry axis of the bottle, the bottle tends to buckle. This tendency of conventional PET bottles to give way under off-axis compressive loads is particularly pronounced for large capacity bottles, such as the two-liter bottle widely used for marketing soft drinks.

Soft drink bottles are ordinarily packaged by bottlers in cases or other containers, several bottles to the case, for shipment to retailers or for storage. Cases of bottles are customarily stacked on top of each other. In warehouses, cases of bottles are frequently stacked on pallets which can be lifted and moved about by fork-lift trucks. The stacks of cases on the pallets must therefore be particularly stable in order to remain standing in the face of the jostling inherent in being moved about. A technique for interconnecting columns of cases, called "cross stacking," is often used to improve the stability of cases of bottles loaded on a warehouse pallet. Cross stacking generally involves stacking rectangular bottle cases to build up a layered structure, with each layer having cases oriented parallel to each other and with the cases in adjacent layers being oriented at right angles to each other. Since each case in the cross-stacked layer rests on at least two cases in the layer below, the cases of the cross-stacked layer tend to keep the cases on which they rest from moving apart from each other. The cross-stacked layer therefore stabilizes the structure.

Because of the tendency of conventional PET beverage bottles to buckle under off-axis loads, attempts to stack cases of these bottles give rise to serious problems. Bottles can tilt away from vertical alignment upon stacking if conventional partitioned cases having low side walls are used to contain the bottles. Tilted bottles in the lower cases of a stack can buckle and give way, causing the stack to fall. Even absent buckling, the tendency of bottles to tilt in conventional low-sided cases causes problems. Tilting generally places an undesirably low limit on the number of tiers in a stack since the tilting of bottles in one case can cause the next higher case in the stack to tilt. This leads to instability if too many tiers are included in the stack.

Previously, these problems were dealt with by packaging beverage bottles in corrugated-paper cartons having high sides, often equal in height to the height of the bottles. Two-liter PET bottles filled with soft drinks were often packaged in enclosed corrugated paper cartons for storage and shipment. Although the high sides of these paper cartons reduce the incidence of tilting and provide additional support when the cartons are stacked, the cartons are expensive. The cost of the cartons cannot ordinarily be distributed over a number of repeated uses since corrugated-paper cartons generally are not rugged enough for reuse and therefore they are usually discarded by the retailer.

One solution to the problems of full depth corrugated-paper cartons is plastic full depth cases. In plastic full depth cases, the sides are load bearing. Full depth plastic cases also have numerous disadvantages. They are expensive to manufacture. They are also expensive to ship and to store empty in a user's warehouse as they require lots of space. Also, they totally surround the bottles, thereby preventing display of the bottles.

To overcome these problems plastic low depth cases have been used. A low depth case is one in which the side walls are lower than the height of the stored bottles, and in which the bottles support the weight of additional cases stacked on top. Some examples of low depth cases follow. However, these too have drawbacks. Some cases, such as the cases disclosed in the deLarosiere, require additional structure to hold the bottles and insure complete bottle stability, even though the case depth is more than 25% of the height of the bottles.

Various plastic reusable bottle carriers are known in the art. One reusable bottle carrier is disclosed in U.S. Pat. No. 3,055,542 to Russo. The bottle carrier can be made of a plastic, and is assembled from two pieces: a handle and a carrier body having six cups for softdrink. bottles. In order to stack the bottle carriers when empty, the handles must be removed. This is very inconvenient and time consuming. The '542 bottle carrier is also seriously limited regarding stacking loaded carriers. It cannot be stacked in a conventional cross-stacked structure because, as shown in FIGS. 3 and 10, the spacing between the bottles in the carriers is different in the directions parallel and perpendicular to the handle of the carrier.

Kappel U.S. Pat. No. 2,970,715 is one of the earlier embodiments of molded plastic low depth bottle carrying cases. Each bottle rests on a raised flat surface within an individual compartment. The bottom of the case is formed with recesses for receiving bottle tops when loaded cases are vertically stacked. However, Kappel does not indicate the size of the carrying case relative the bottles being carried.

In Bunnell, U.S. Pat. No. 3,812,996, a reusable plastic bottle carrying case for beer bottles is disclosed. The case is designed with a plurality of bottle compartments having flat bottom walls. The cases are designed to be cross-stacked; the cases are dimensioned so that the center-to-center distance between adjacent bottles within a case is the same as the center-to-center distance between adjacent bottles in adjacent cases in abutting relationship. The bottles are co-linear. Although a plurality of loaded carrying cases is designed to be vertically stackable with the weight of upper cases supported by the bottles within lower cases, the outer surface of the bottom wall of the case is flat.

Garcia, U.S. Pat. No. 3,247,996 discloses a low depth plastic bottle container for milk bottles. The container is shorter than the bottles which extend above the top surface of the container walls. In Garcia, the bottles, rather than the walls of the container, are load bearing. Indented circular portions may be formed in the bottom wall to receive bottle tops when containers are vertically stacked. Like many prior art bottle carriers, the Garcia container is a low depth case that can be used with a variety of bottles. However, the case is not a very low depth case and is more expensive than very low depth cases. It also does not have the display capabilities of very low depth cases.

A more recent attempt to solve the problem of providing reusable, cross-stackable PET bottle cases is disclosed in U.S. Pat. No. 4,344,530 to deLarosiere. The '530 patent has many of the features and problems of Garcia and discloses a plastic PET bottle case that is cross stackable and has a very low depth as shown in the figures. This low depth is disclosed as being approximately 1/6 the height of the PET bottles, or approximately 2 inches. However, in practice, this depth is insufficient and does not prevent bottles from tipping over. This creates a large degree of lateral instability. In practice these cases are 3–3¼ inches high. Additionally, the bottle retaining pockets are required to have a raised annular bottle seat ring which fits within the inner indentation formed in the base of many bottles to insure bottle stability. Also, this does not permit petaloid bottles to rotate within the bottle pockets for display purposes. Additionally, it does not permit bottles without a base indentation to be adequately retained. deLarosiere also incorporates a bottle spacing feature that co-linearly aligns bottles to facilitate cross stacking.

SUMMARY OF THE INVENTION

It is an object of the present invention to provide a durable plastic reusable bottle case having a very low depth that is stable when full cases or empty cases are stacked on top of each other.

It is another object of the present invention to provide a stackable bottle case in which bottles do not tip when a plurality of loaded cases are stacked on top of each other, in which additional bottle base support structure is unnecessary, in which bottles without base indentations may be retained, and in which petaloid bottles may be rotated.

It is another object of the present invention to provide a bottle case having the above features that uses less material, is lighter in weight, and is cheaper to manufacture.

These and other objects are attained by the stackable low depth case of the present invention. The case includes four side walls and a bottom portion. A plurality of upwardly projecting hollow columns are disposed in the bottom portion. These columns preferably do not extend from the top surface of the bottom portion. The columns, walls, and bottom portion define a plurality of bottle retaining pockets. The bottle retaining pockets have flat bottom surfaces to permit retention of bottles without base indentations and to permit rotation of bottles. The columns extend upwardly from the base portion a distance approximately one third of the height of the bottles to be retained. The columns are hollow to permit empty cases to stack top to bottom. The lower surface of the bottom portion has circular concave portions with central retaining openings to facilitate stacking of filled cases top to bottom. When a case is disposed on a loaded lower case, the bottle tops of the bottles in the lower case are guided toward the central retaining openings by the circular concave portions.

The case of this invention has a very low depth with upwardly extending columns. This provides numerous advantages. This case may be formed without special bottle base supports because the columns give the case a higher effective height. This also enhances bottle visibility and reduces manufacturing costs.

The case may be used for any size bottles such as 2-liter and 3-liter bottles. The case may be shaped to receive 6, 8, or any other number of bottles as well as 6-packs and 8-packs. Additionally the effective height of the case, the total column height, need not be limited to ⅓ the height of the bottles.

Various additional advantages and features of novelty which characterize the invention are further pointed out in the claims that follow. However, for a better understanding of the invention and its advantages, reference should be made to the accompanying drawings and descriptive matter which illustrate and describe preferred embodiments of the invention.

DETAILED DESCRIPTION OF PREFERRED EMBODIMENTS

Figure 1:
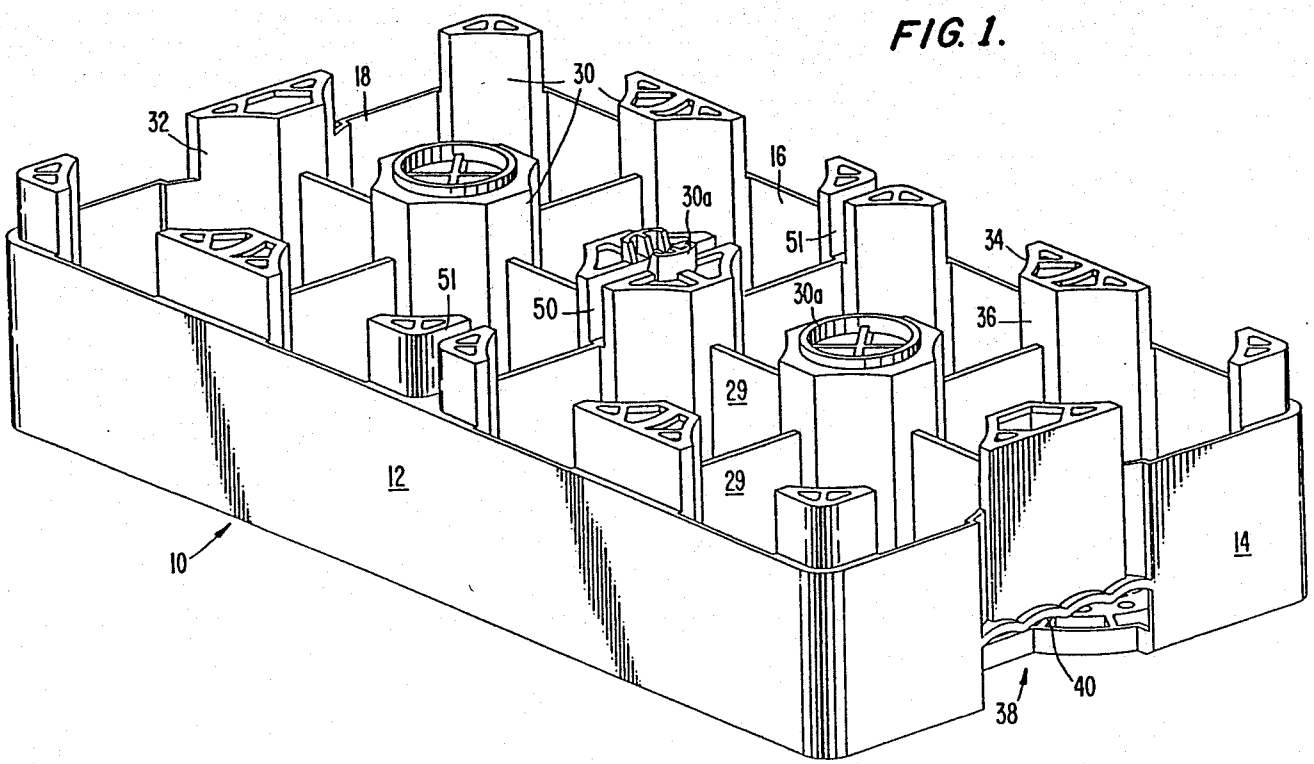
FIG. 1 is a perspective view of a stackable low depth case according to the present invention.

As shown in FIG. 1, the stackable low depth bottle case 10 has four side walls 12, 14, 16, 18. Side walls 12, 16 are relatively long and side walls 14, 18 (end walls) are relatively short. Case 10 is rectangular and is therefore symmetric about both center lines which bisect the bottom surface. The depth or height of side walls 12, 14,

16, 18 is relatively low compared to the height of the bottles retained therein. Preferably, case 10 is rectangular and symmetric around both central axes. The ratio of the length of long side walls 12, 16 to the length of short side walls 14, 18 is substantially equal to the ratio of the number of bottles the case holds in the lengthwise direction to the number of bottles the case holds in the widthwise direction. For example, an 8-bottle case is twice as long as it is wide and holds bottles in a 4×2 relationship.

Figure 4:
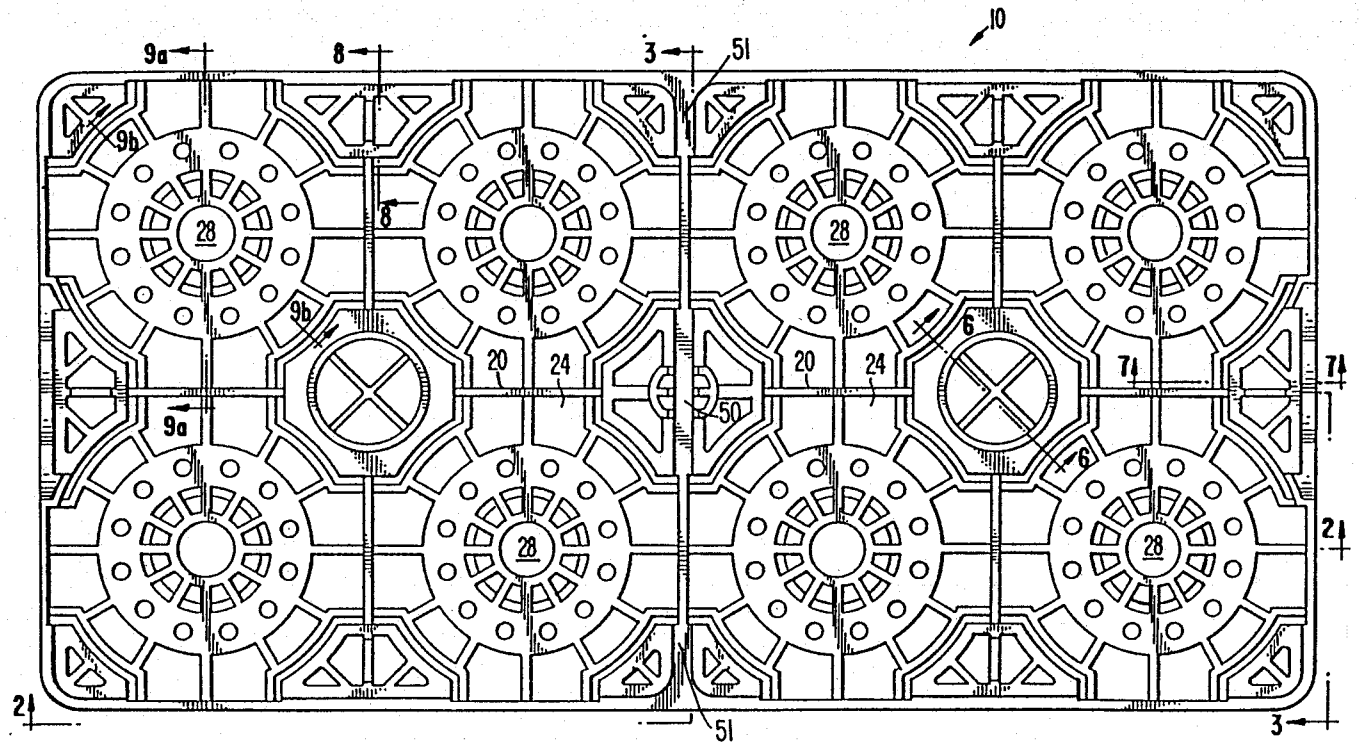
FIG. 4 is a top view of the case of FIG. 1.
Figure 5:
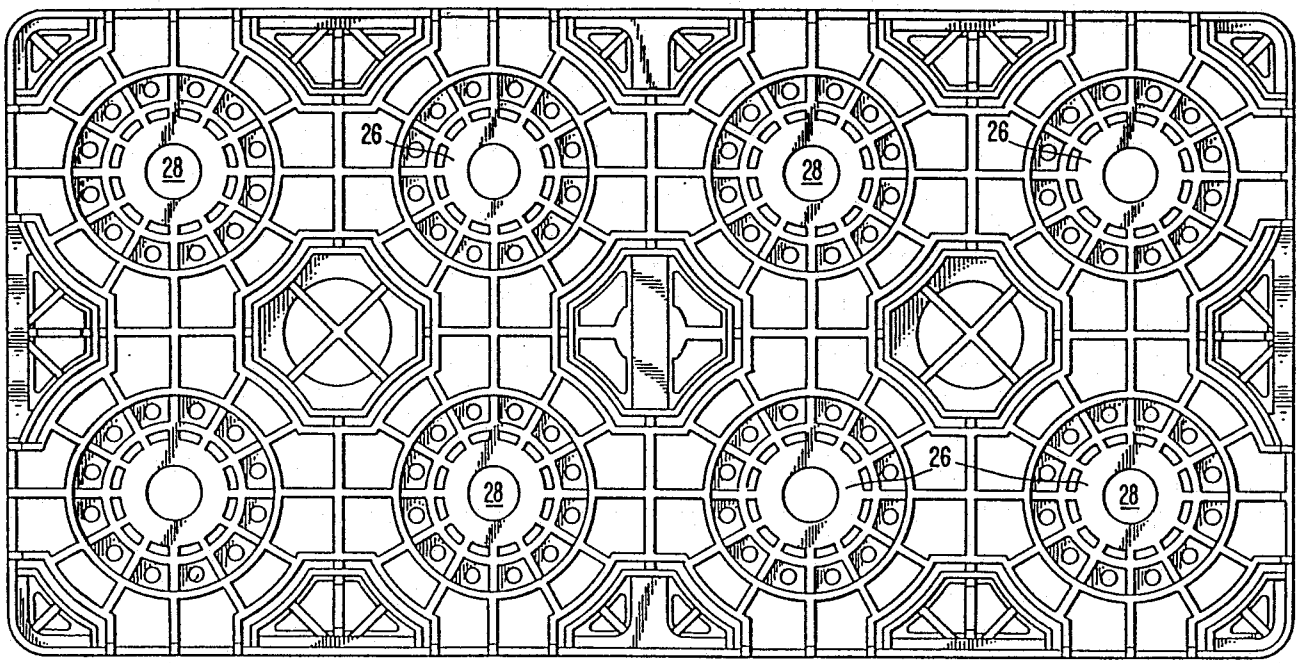
FIG. 5 is a bottom view of the case of FIG. 1.
Figure 6:
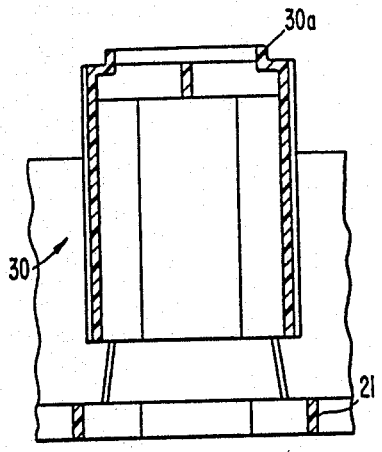
FIG. 6 is a sectional view taken along line 6—6 of FIG. 4.
Figure 7:
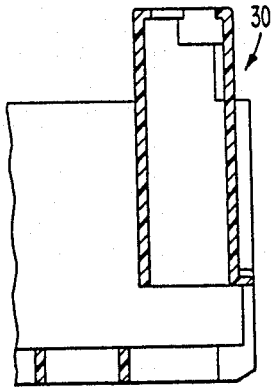
FIG. 7 is a sectional view taken along line 7—7 of FIG. 4.
Figure 8:
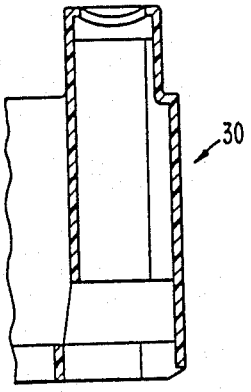
FIG. 8 is a sectional view taken along line 8—8 of FIG. 4.

As best shown in FIGS. 4 and 5, case 10 also includes a bottom portion 20 attached to side walls 12, 14, 16, 18 to form the outer shell of case 20. Preferably, case 10 is made from plastic and is molded integrally as a single component. Bottom portion 20 has an upper surface 22 and a lower surface 24. Upper surface 22 is substantially flat. Lower surface 24 is formed as a plurality of circular concave portions 26 each having a central retaining opening 28 disposed therein. The number of circular concave portions corresponds to the number of bottles the case is designed to retain. The function of circular concave portions 26 and central retaining openings 28 will be described in detail below.

Case 10 is formed having a plurality of vertical walls 29 and upwardly projecting hollow columns 30 disposed within side walls 12, 14, 16, 18. In the embodiment of FIGS. 1–11 columns 30 do not extend to and do not contact the top surface of bottom portion 20. Vertical walls 29 do extend to the top surface of bottom portion 20. The side edges of vertical walls 29 abut columns 30 and help to secure columns 30 to bottom portion 20. Vertical walls 29 and columns 30, when combined with upper surface 22 of bottom portion 20 and sidewalls 12, 14, 16, 18, define a plurality of bottle retaining pockets 32. Columns 30 are hollow to permit vertical stacking of empty cases 10. Columns 30 extend above bottom portion 20 a distance approximately one third of the height of the bottles to be retained in case 10. This increases the effective height of the case while maintaining high bottle visibility and low manufacturing costs. For example, where cases 10 are shaped to retain 2-liter bottles, columns 30 extend upwardly approximately four inches. Columns 30 are disposed either along the walls 12, 14, 16, 18 or away from the walls, centrally within bottom portion 20. Columns 30 disposed in the corners between two adjacent walls have one curved surface 34. Columns 30 disposed on the sides of one of the walls have two curved surfaces 34 and one flat surface 36 disposed therebetween. The two curved surfaces 34 help define two separate and adjacent bottle retaining pockets 32. Flat surface 36 is disposed between these two bottle retaining pockets. Columns 30 that are disposed centrally within bottle portion 20 are octagonally shaped. These columns 30 have four alternating curved surfaces 34 and four alternating flat surfaces 36. The four curved surfaces 34 define portions of four bottle retaining pockets 32 and the four flat surfaces 36 separate these pockets. Four curved surfaces 34 on four separate columns 30 form the four corners of a bottle retaining pocket 32. Thus, columns 30 having two curved surfaces 34 form a corner of two adjacent bottle retaining pockets 32, and columns 30 having four curved surfaces 34 form a corner of four adjacent bottle retaining pockets 32. As seen in FIGS. 1, 2, 4 and 11, the columns disposed about a centerline of the length of the case include recesses 50 and 51 which extend downwardly to a height which substantially equals a side wall height for receiving a side wall of an identical upper crate.

The upper surface 22 of bottom portion 20 within bottle retaining pockets 32 is substantially flat. This permits retention of bottles regardless of the configuration of the bottom of the bottles. Also, this allows petaloid bottles to be rotated within the bottle retaining pockets to facilitate display of the product. The very low depth feature of case 10 further enhances product display.

Figure 2:
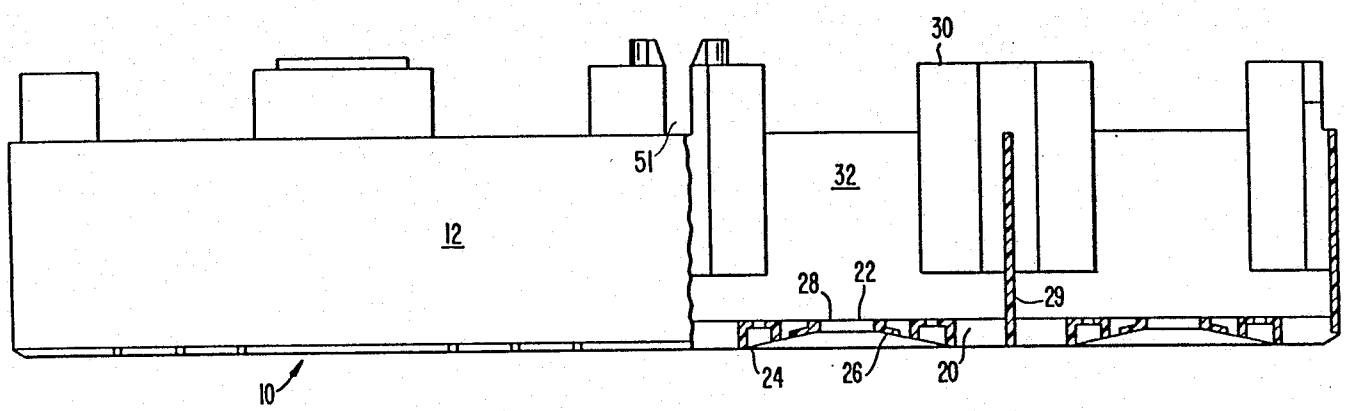
FIG. 2 is a side view, partially in section taken along line 2—2 of FIG. 4, of the case of FIG. 1.
Figure 3:
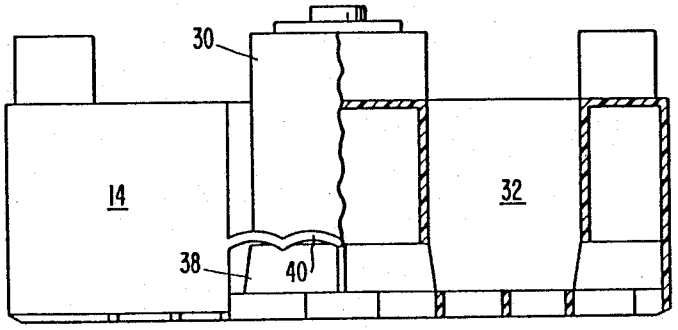
FIG. 3 is an end view, partially in section taken along line 3—3 of FIG. 4, of the case of FIG. 1.
Figure 9B:
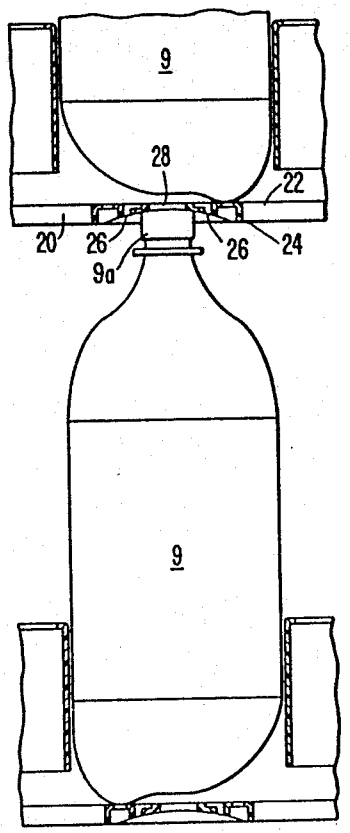
FIG. 9*b* is taken along line 9*b*—9*b* of FIG. 4**.
Figure 9A:
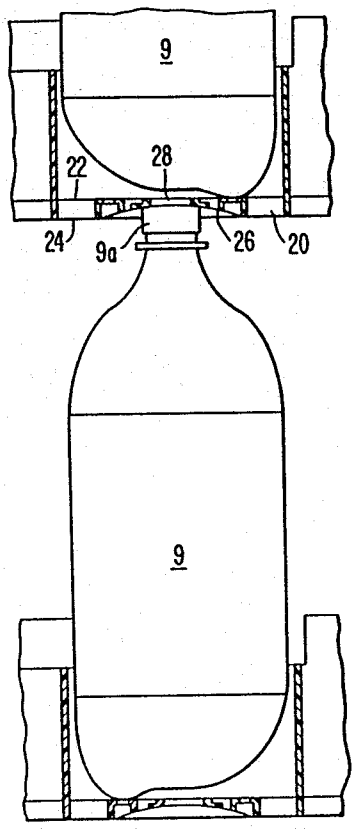
FIG. 9 shows partial sectional views illustrating an upper case stacked on top of a lower case with the lower case filled with bottles. FIG. **9*a* is taken along line 9*a*—9*a* of FIG. 4.

The circular concave portions 26 of lower surface 24, shown clearly in FIG. 2, allow cases 10 filled with bottles to be vertically stacked for transportation, storage, and display purposes. Circular concave portions 26 are formed of ribs or projections which define the circular concave shape. These ribs also form central retaining opening 28. Central retaining opening 28 is sized to receive the bottle top 9*a* of a bottle 9 which is disposed in a lower case 10 as shown in FIG. 9. Bottle top 9*a* fits adjacent central retaining opening 28 so that central retaining opening 28 retains bottle top 9*a* in position against lower surface 24. The concave shape of circular concave portion 26 assists bottle top 9*a* to abut central retaining opening 28. When an upper case 10 is being positioned on loaded lower case 10, often bottle tops 9*a* will not precisely line up with respective central retaining openings 28. However, bottle tops 9*a* will contact circular concave portions 26 which, because of their concave shape, will guide bottle tops 9*a* into central retaining openings 28. Additionally, the center-to-center distances between adjacent bottle retaining pockets within one case are substantially equal. Similarly, the center-to-center distances between adjacent bottle retaining pockets in adjacent cases with abutting side walls is substantially equal.

A plurality of empty cases 10 may also be stably stacked on top of each other. Because columns 30 are hollow, in one embodiment, at least a portion of column 30 in a lower case 10 may be disposed within a portion of a respective column 30 in an upper case 10. This permits a stable male-female type interlocking. This stacking arrangement can be performed with the embodiment of case 10 illustrated in FIGS. 12–16.

Figure 10:
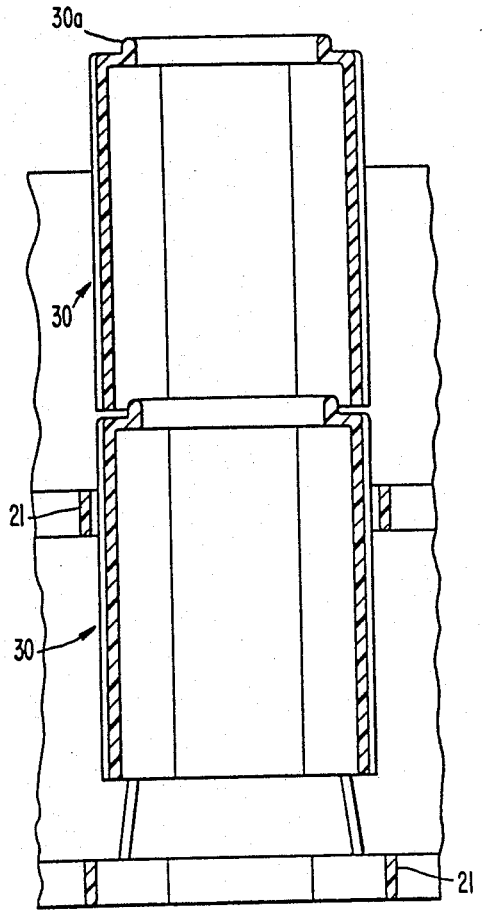
FIG. 10 is a sectional view similar to that of FIG. 6, which is taken along line 6—6 of FIG. 4, showing two empty stacked cases.
Figure 11:
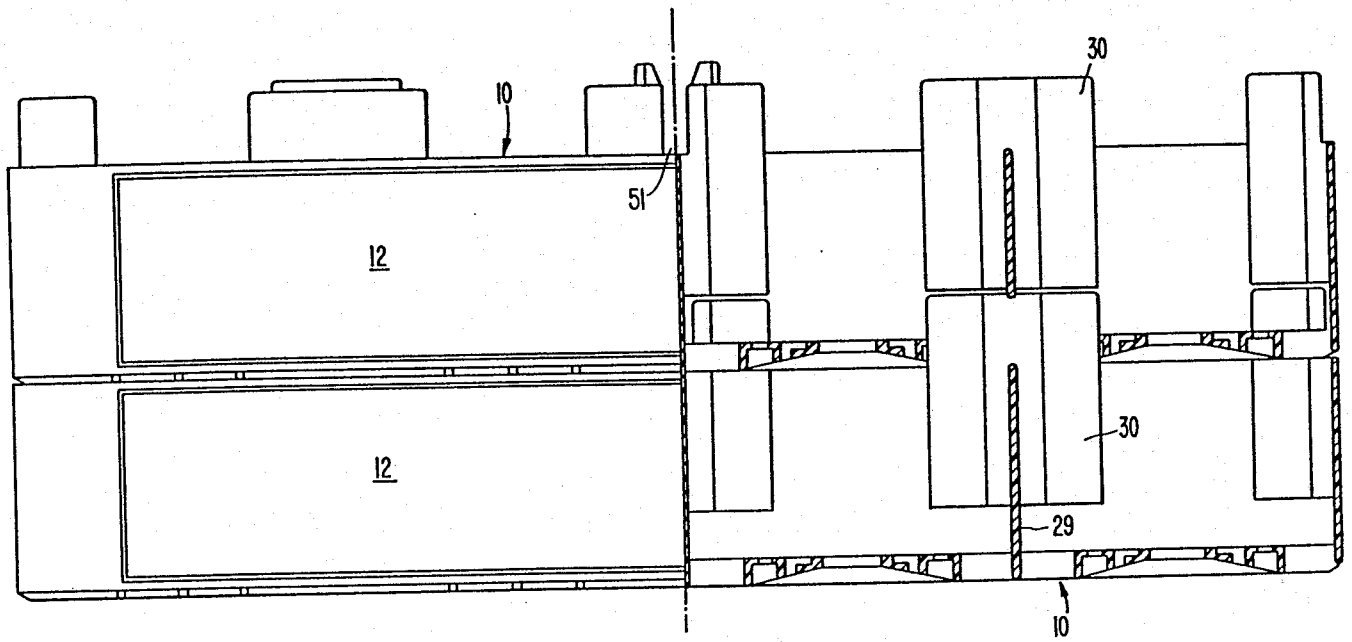
FIG. 11 is a sectional view similar to that of FIG. 2, which is taken along line 2—2 of FIG. 4, showing a side view of two empty stacked cases.
Figure 12:
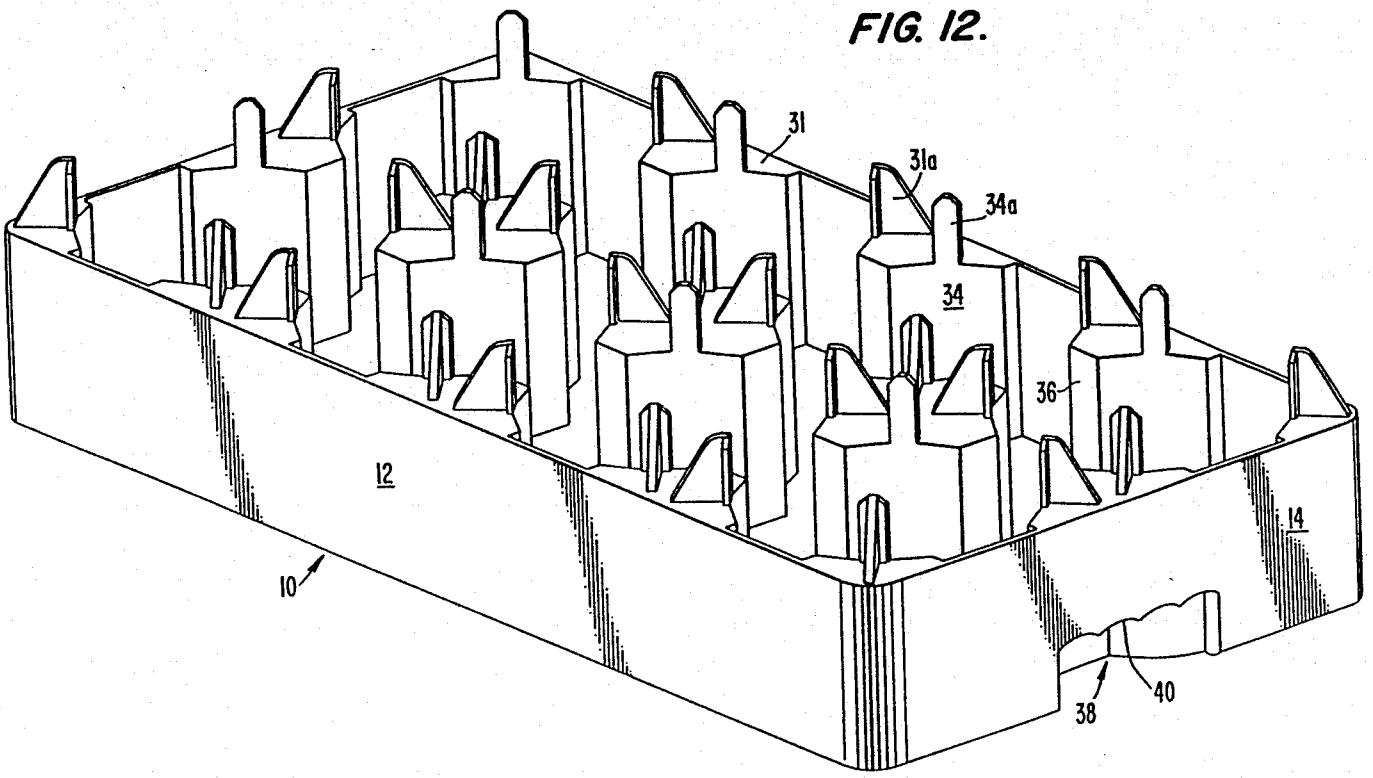
FIG. 12 is a perspective view of a stackable low depth case according to another embodiment of the present invention.
Figure 13:
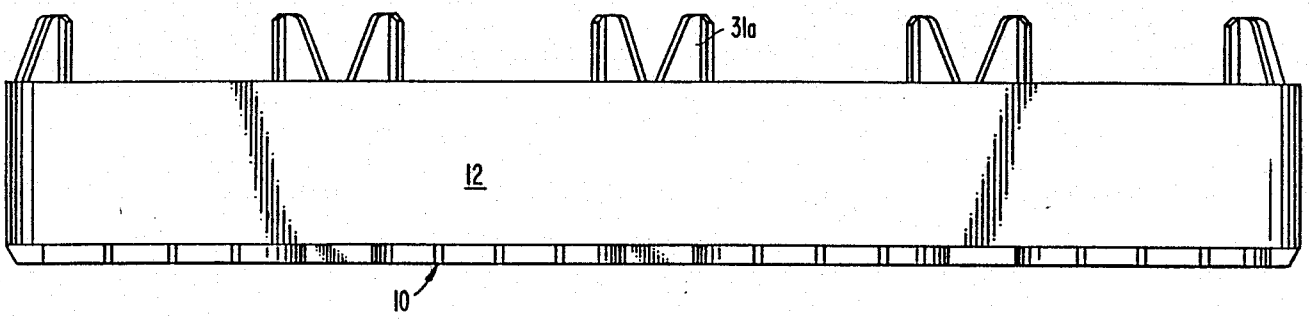
FIG. 13 is a side view of the case of FIG. 12.
Figure 14:
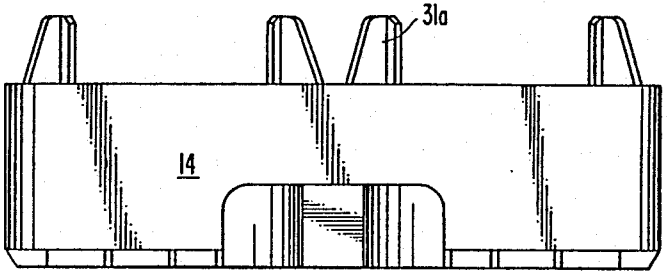
FIG. 14 is an end view of the case of FIG. 12 having a different handle portion.
Figure 15:
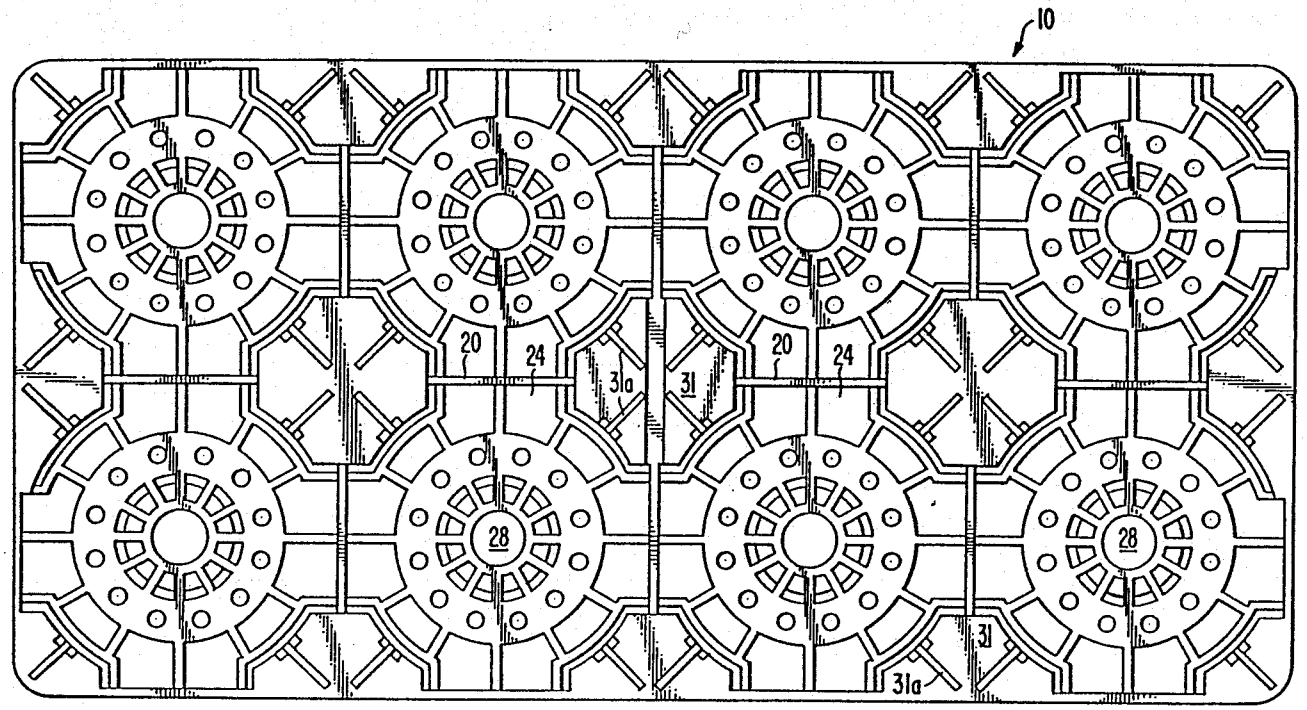
FIG. 15 is a top view of the case of FIG. 12.
Figure 16:
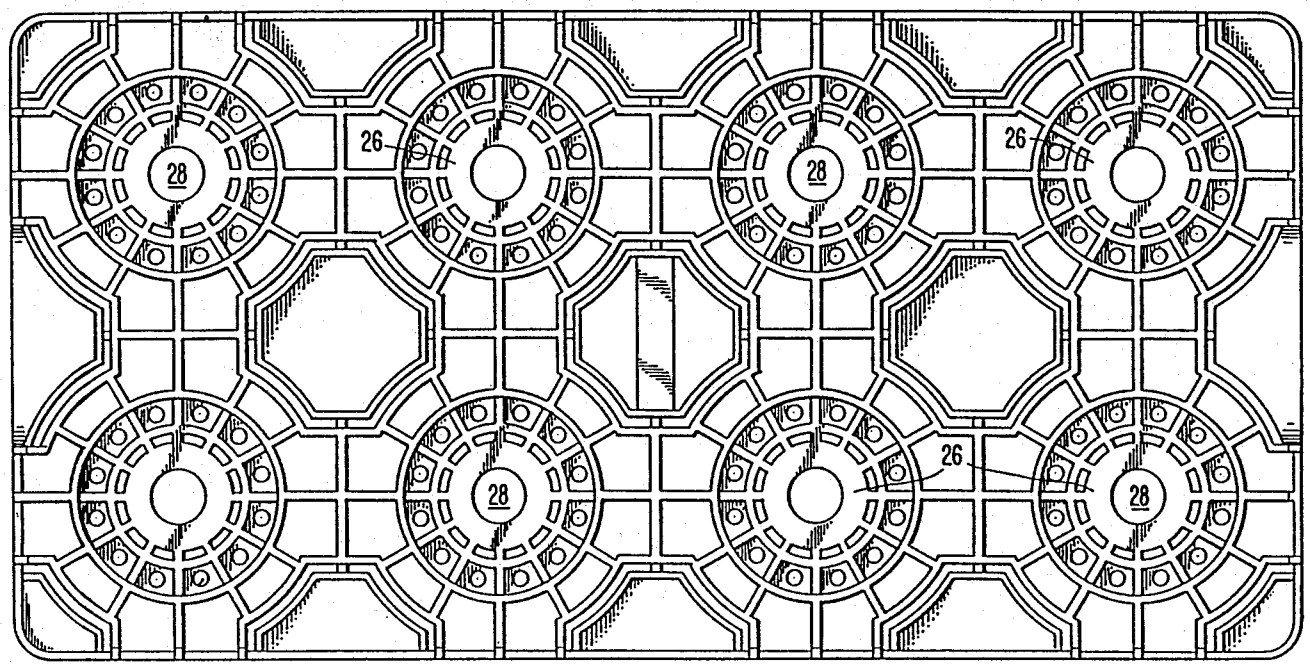
FIG. 16 is a bottom view of the case of FIG. 12.

In the embodiment of FIGS. 1–11, a slightly different interlocking of empty stacked cases 10 occurs. As best illustrated in FIGS. 2, 3, 6, 7, 8, and 11, columns 30 do not extend to bottom portion 20. There is a gap between bottom portion 20 and the bottom of columns 30. This configuration allows empty cases of the FIG. 1 embodiment to stack vertically without having the lower portion of columns 30 taper outwardly to receive columns 30 of a lower case 10. As shown in FIGS. 10 and 11, two empty cases 10 are stacked vertically. The top portions of columns 30 of the lower case do not extend into columns 30 of the upper case. Only projecting portion 30*a* of a lower column 30, shown in FIG. 10, which is disposed only on some columns 30 as described below, enters an upper column 30. Lower columns 30 fit within ribs 21 located on bottom portion 20 of case 10 and corresponding to respective columns 30. The interlocking of columns 30 within ribs 21 securely and stably connects empty stacked cases 10.

Side walls 14, 18, are formed with handle portions 38 to facilitate carrying case 10. Preferably, handle portions 38 have finger recesses 40 to further aid carrying case 10. In one preferred embodiment, some columns 30 may have slightly different heights than the remaining columns 30. In FIG. 1, the central columns 30 have projecting portions 30a which extend above the other columns 30. This causes cases 10 to wobble when placed upside down on a flat surface and prevents cases 10 from being used upside down merely as stacking boxes to stack other items. In FIG. 2, one of projecting portions 30a is not shown to provide a better illustration for FIG. 11.

FIGS. 12–16 illustrate an alternate embodiment of the stackable low depth case of the present invention. In this embodiment, the shape and construction of columns 30 differs from that of the first embodiment. Also, vertical walls 29 are not used. The remaining features of the case are otherwise the same.

In this embodiment, columns 30 are formed with horizontal platforms 31 located at a level substantially coplanar with the top of side walls 12, 14, 16, 18. Projections 31a are disposed on platforms 31. Projections 31a include a substantially triangular or wedge-shaped support portion and have curved surfaces 34a extending from curved surfaces 34 of columns 30. Curved surfaces 34a are narrower than curved surfaces 34 to decrease the weight and bulk of the case and curved surfaces 34a lie in the same curved plane as respective curved surfaces 34. The wedge-shaped portion of projections 31a are substantially perpendicular to curved surfaces 34a. When empty cases of this embodiment are stacked top to bottom, projections 31a of a lower case may fit within the openings of respective columns 30 of an adjacent upper case if columns 30 extend to the top surface of bottom portion 20.

Numerous characteristics, advantages, and embodiments of the invention have been described in detail in the foregoing description with reference to the accompanying drawings. However, the disclosure is illustrative only and the invention is not limited to the precise illustrated embodiments. Various changes and modifications may be effected therein by one skilled in the art without departing from the scope or spirit of the invention.

We claim:

1. A stackable low depth case for retaining and transporting bottles comprising:

a plurality of outer side walls forming an outer shell having a low depth;

a bottom portion attached to said side walls;

a plurality of spaced upwardly projecting columns generally disposed within said side walls defining, in combination with said bottom portion and said outer side walls, a plurality of bottle retaining pockets with at least one column per pocket, said columns extending above a top surface of one of said side walls and below a top surface of the retained bottles; and said bottom portion includes:

an upper surface which is substantially flat across the bottle retaining pockets; and means for resting said bottom portion on closures of bottles on which said case is stacked and for guiding each closure coaxially with a centerline of one of said bottle retaining pockets;

wherein when said case is empty, said columns of said case interlock with an upper case when said cases are stacked bottom to top, and when a subjacent case is loaded, the closures of bottles disposed in the subjacent case abut said bottom portion resting and guiding means when said cases are stacked bottom to top.

2. A stackable low depth case according to claim 1 wherein said columns project upwardly from and contact said bottom portion.

3. A stackable low depth case for retaining and transporting bottles comprising:

a plurality of outer side walls forming an outer shell having a low depth;

a bottom portion attached to said side walls, said bottom portion having ribs;

a plurality of spaced upwardly projecting hollow columns generally disposed within said side walls defining, in combination with said bottom portion and said outer side walls, a plurality of bottle retaining pockets with at least one column per pocket, said columns extending above a top surface of one of said side walls and below a top surface of the retained bottles, and wherein at least some of said ribs correspond in location to said columns; and said bottom portion includes:

an upper surface which is substantially flat across said bottle retaining pockets; and means for resting said bottom portion on closures of bottles on which said case is stacked and for guiding each closure coaxially with a centerline of one of said bottle retaining pockets;

wherein when said case is empty, said columns of said case fit within ribs corresponding to respective columns on an identical upper case when said cases are stacked bottom to top, and when a subjacent case is loaded, the closures of bottles disposed in the subjacent case abut said bottom portion resting and guiding means when said cases are stacked bottom to top.

4. A stackable low depth case according to claim 3 further comprising a plurality of vertical walls within said outer side walls adjacent and extending from said columns which further define said plurality of bottle retaining pockets.

5. A stackable low depth case according to claim 3 wherein said columns do not contact said bottom portion thereby forming a gap between the upper surface of said bottom portion and said columns.

6. A stackable low depth case according to claim 3 wherein each of said columns have at least one surface, at least above the top surface of said side walls, curved to substantially conform to the shape of the bottles to be retained and transported in said bottle retaining pockets.

7. A stackable low depth case according to claim 6 wherein at least one column is centrally disposed and is substantially octagonal in shape, and four alternate sides of said octagon are curved, at least above the top surface of said side walls, to substantially conform to the shape of the bottles to be retained and transported in said bottle retaining pockets.

8. A stackable low depth case according to claim 6 wherein said columns have horizontal platforms substantially coplanar with the top surface of said side walls, said columns include upwardly disposed projections above said surface, and said projections have surfaces which are curved to substantially conform to the shape of the bottles to be retained and transported in said bottle retaining pockets.

9. A stackable low depth case according to claim 8 wherein said projections further comprise support portions.

10. A stackable low depth case according to claim 3 wherein when said case is empty, said columns of said case fit within a hollow portion of columns on said identical upper case when said cases are stacked bottom to top.

11. A stackable low depth case according to claim 3 wherein said bottom portion resting and guiding means are opposite said substantially flat upper surface and includes substantially circular concave lower surfaces with each of said concave lower surfaces having a centrally located bottle closure receiving portion and the closures of bottles disposed in a subjacent case abut said centrally located bottle closure receiving portions of said concave lower surfaces of said case when said cases are stacked bottom to top.

12. A stackable low depth case according to claim 11 wherein each of said bottle closure receiving portions have central retaining openings.

13. A stackable low depth case according to claim 3, wherein some of said columns have projecting portions extending above the topmost point on other said columns.

14. A stackable low depth case according to claim 3 wherein said bottle retaining pockets are shaped to receive two-liter bottles and said columns extend approximately four inches above said lower surface of said bottom portion.

15. A stackable low depth case according to claim 3 further comprising four side walls wherein said four side walls form a rectangular outer shell.

16. A stackable low depth case according to claim 15 wherein the ratio of the length to the width of said outer shell is substantially equal to the ratio of the number of bottles said case holds in the lengthwise direction to the number of bottles said case holds in the widthwise direction so that a plurality of said cases may be cross stacked, wherein at least some of said cases in one layer can be disposed at 90° angles from cases in adjacent layers and the center-to-center distance between adjacent bottle retaining pockets within said case and between two adjacent cases having abutting side walls are substantially equal.

17. A stackable low depth case according to claim 3 wherein said columns extend above said bottom portion a distance approximately one third of the height of the bottles to be retained and transported.

18. A stackable low depth case according to claim 3 wherein said bottle retaining pockets are shaped to receive 2-liter PET bottles.

19. A stackable low depth case for retaining and transporting bottles comprising:

four outer side walls forming a rectangular outer shell having a low depth;

a bottom portion attached to said side walls, said bottom portion having ribs; and a plurality of spaced upwardly projecting hollow columns generally disposed within said side walls defining, in combination with said bottom portion and said outer side walls, a plurality of bottle retaining pockets with at least one column per pocket, said columns extending above a top surface of one of said side walls and above said bottom portion a distance approximately one third of the height of the retained bottles, and wherein at least some of said ribs correspond in location to said columns;

wherein said bottom portion includes:

an upper surface which is substantially flat across the bottle retaining pockets; and means for resting said bottom portion on closures of bottles on which said case is stacked and for guiding each closure coaxially with a centerline of one of said bottle retaining pockets;

wherein when said case is empty, said columns of said case fit within ribs corresponding to respective columns on an identical upper case when said cases are stacked bottom to top, and when a subjacent case is loaded, the closures of bottles disposed in the subjacent case abut said centrally located bottle closure receiving portions of said concave lower surfaces of said case when said cases are stacked bottom to top; and wherein the ratio of the length to the width of said outer shell is substantially equal to the ratio of the number of bottles said case holds in the lengthwise direction to the number of bottles said case holds in the widthwise direction so that a plurality of said cases may be cross stacked, wherein at least some of said cases in one layer are disposed at 90° angles from cases in adjacent layers and the center-to-center distance between adjacent bottle retaining pockets within said case and between two adjacent cases having abutting side walls are substantially equal.

20. A stackable low depth case according to claim 19 wherein said columns do not contact said bottom portion and thereby form a gap between the upper surface of said bottom protion and said columns.

21. A stackable low depth case for retaining and transporting bottles comprising:

four outer side walls forming a rectangular outer shell having a low depth;

a bottom portion attached to said side walls, said bottom portion having ribs; and a plurality of spaced upwardly projecting hollow columns having curved sides generally disposed within said side walls defining, in combination with said bottom portion and said outer side walls, a plurality of bottle retaining pockets shaped to receive 2-liter PET bottles with at least one column per pocket, said columns extending above a top surface of one of said side walls and approximately four inches above said bottom portion, wherein some of said columns have upwardly extending projecting portions extending above the topmost point on other of said columns, three centrally disposed columns are substantially octagonal in shape, four alternate sides of each of said octagonally shaped columns are curved, at least above the top surface of said side walls to substantially conform to the shape of the bottles to be retained and transported in adjacent said bottle retaining pockets, and at least some of said ribs correspond in location to said columns;

wherein said bottom portion includes:

an upper surface which is substantially flat across said bottle retaining pockets; and means for resting said bottom portion on closures of bottles on which said case is stacked and for guiding each closure coaxially with a centerline of one of said bottle retaining pockets;

wherein when said case is empty, said columns of said case fit within ribs corresponding to respective columns on an identical upper case when said cases are stacked bottom to top, and when a subjacent crate is loaded, the closures of bottles disposed in the subjacent case abut said centrally located bottle closure receiving portions of said concave lower surfaces of said case when said cases are stacked bottom to top; and wherein the ratio of the length to the width of said outer shell is substantially equal to the ratio of the number of bottles said case holds in the lengthwise direction to the number of bottles said case holds in the widthwise direction so that a plurality of said cases may be cross stacked, wherein at least some of said cases in one layer are disposed at 90° angles from cases in adjacent layers and the center-to-center distance between adjacent bottle retaining pockets within said case and between two adjacent cases having abutting side walls are substantially equal.

22. A stackable low depth case according to claim 21 wherein said columns do not contact said bottom portion thereby forming a gap between the upper surface of said bottom portion and said columns.

23. A stackable low depth case for retaining and transporting bottles comprising:

a plurality of outer side walls forming an outer shell having a low depth;

a bottom portion attached to said side walls;

a plurality of spaced upwardly projecting hollow columns generally disposed within said side walls defining, in combination with said bottom portion and said outer side walls, a plurality of bottle retaining pockets with at least one column per pocket, said columns having horizontal platforms disposed substantially coplanar with a top surface of one of said side walls and a plurality of upwardly disposed projections, at least one of said projections extending from each of said platform of said columns, said projections extending above a top surface of one of said side walls and below a top surface of the retained bottles, said projections forming an extension of said bottle retaining pockets; and said bottom portion includes:

an upper surface which is substantially flat across the bottle retaining pockets; and means for resting said bottom portion on closures of bottles on which said case is stacked and for guiding each closure coaxially with a centerline of one of said bottle retaining pockets;

wherein when said case is empty, said columns of said case fit within a hollow portion of columns on an upper case when said cases are stacked bottom to top, and when a subjacent crate is loaded, the closures of bottles disposed in the subjacent case abut said bottom portion resting and guiding means when said cases are stacked bottom to top.

24. A stackable low depth case according to claim 23 wherein said columns and said projections have coplanar surfaces which are curved to substantially conform to the shape of the bottles to be retained and transported in said bottle retaining pockets.

25. A stackable low depth case according to claim 23 wherein said projections include support portions.

26. A stackable low depth case as in claim 23 wherein some of said projections extend above the topmost points on other of said projections.

27. A stackable low depth case as in claim 1, wherein at least one of said columns can be associated with more than one of said pockets.

28. A stackable low depth case as in claim 3, wherein at least one of said columns can be associated with more than one of said pockets.

29. A stackable low depth case as in claim 8, wherein said projection curved surfaces are coplanar with surfaces of said columns below said surface.

30. A stackable low depth case as in claim 19, wherein at least one of said columns can be associated with more than one of said pockets.

31. A stackable low depth case as in claim 21, wherein at least one of said columns can be associated with more than one of said pockets.

32. A stackable low depth case as in claim 23, wherein at least one of said columns can be associated with more than one of said pockets.

33. A stackable low depth case for retaining and transporting bottles comprising:

a plurality of outer side walls forming an outer shell having a low depth;

a case bottom disposed substantially within said outer shell; and a plurality of means, generally disposed within said outer shell and extending at least above a top surface of one of said side walls, for increasing the effective height of the case to thereby limit the tilting movement of the bottles to be retained and transported, said plurality of effective case height increasing means defining, in combination with said case bottom and said outer shell, a plurality of bottle retaining pockets with at least one effective case height increasing means per pocket;

said case bottom includes:

an upper surface which is substantially flat across the bottle retaining pockets; and means for resting the case bottom on closures of bottles in a subjacent case and for aligning each closure with said case bottom for stacking said case.

34. A stackable low depth case as in claim 33, wherein each of said plurality of effective case height increasing means extend above said upper surface of said case bottom a distance approximately one-third of the height of the bottles to be retained and transported.

35. A stackable low depth case as in claim 33, wherein the plurality of effective case height increasing means extend upwardly from and contact said case bottom upper surface.

36. A stackable low depth case as in claim 33, wherein at least one of said effective case height increasing means includes a projecting portion extending above a topmost point of at least some of the other of said effective case height increasing means.

37. A stackable low depth case as in claim 33, wherein said outer shell is rectangular having a longer length than width and having the ratio of the length to the width of the outer shell be substantially equal to the ratio of the number of bottles said case holds in a lengthwise direction to the number of bottles said case holds in a widthwise direction; and at least one of said effective case height increasing means is disposed along a centerline of the length of the case and extending above at least a top surface of one of said side walls, said at least one effective case height increasing means disposed along a centerline of the length of the case includes a recess for receiving a side wall of an identical upper crate so that an identical upper crate can be cross-stacked with said case when said case is empty and the center-to-center distance between adjacent bottle retaining pockets within said case and between said case and the upper identical case are substantially equal.

38. A stackable low depth case as in claim 33, wherein at least one of said effective case height increasing means can be associated with more than one of said pockets.

39. A stackable low depth case for retaining and transporting bottles comprising:

a plurality of outer side walls forming an outer shell having a low depth;

a case bottom disposed substantially within said outer shell; and a plurality of columns, generally disposed within said outer shell, extending at least above a top surface of one of said side walls and defining, in combination with said case bottom and said outer shell, a plurality of bottle retaining pockets with at least one column per pocket;

said case bottom includes:

an upper surface which is substantially flat across the bottle retaining pockets; and means for resting the case bottom on closures of bottles in a subjacent case and for aligning each closure with said case bottom for stacking said case.

40. A stackable low depth case for retaining and transporting bottles comprising:

a plurality of outer side walls forming an outer shell having a low depth;

a case bottom disposed substantially within said outer shell; and a plurality of means, generally disposed within said outer shell, for increasing the effective height of the case to thereby limit the tilting movement of the bottles to be retained and transported, said plurality of effective case height increasing means defining, in combination with said case bottom and said outer shell, a plurality of bottle retaining pockets, with at least one effective case height increasing means per pocket and with each of said plurality of effective case height increasing means including at least one surface which is extending at least above a top surface of one of said side walls and is curved to substantially conform to the shape of the bottles to be retained and transported;

said case bottom includes means for resting said case bottom on closures of bottles in a subjacent case and for aligning each closure with said case bottom for stacking said case.

41. A stackable low depth case as in claim 40, wherein said case bottom comprises an upper surface which is substantially flat across the bottle retaining pockets.

42. A stackable low depth case as in claim 40, wherein each of said plurality of effective case height increasing means extend above the case bottom a distance of approximately one-third of the height of the bottles to be retained and transported.

43. A stackable low depth case as in claim 40, wherein the plurality of effective case height increasing means extend upwardly from and contact said case bottom.

44. A stackable low depth case as in claim 40, wherein at least one of said effective case height increasing means includes a projecting portion extending above a topmost point of at least some of the other of said effective case height increasing means.

45. A stackable low depth case as in claim 40, wherein said outer shell is rectangular having a longer length than width and having the ratio of the length to the width of the outer shell be substantially equal to the ratio of the number of bottles said case holds in a lengthwise direction to the number of bottles said case holds in a widthwise direction; and at least one of said effective case height increasing means is disposed along a centerline of the length of the case and extending above at least a top surface of one of said side walls, said at least one effective case height increasing means disposed along a centerline of the length of the case includes a recess for receiving a side wall of an identical upper crate so that an identical upper crate can be cross-stacked with said case when said case is empty and the center-to-center distance between adjacent bottle retaining pockets within said case and between said case and the upper identical case are substantially equal.

46. A stackable low depth case as in claim 40, wherein at least one of said effective case height increasing means can be associated with more than one of said pockets.

47. A stackable low depth case for retaining and transporting bottles comprising:

a plurality of outer side walls forming an outer shell having a low depth;

a case bottom disposed substantially within said outer shell;

a plurality of columns, generally disposed within said outer shell, said columns defining, in combination with said outer shell and said case bottom, a plurality of bottle retaining pockets with at least one column per pocket and each of said columns including at least one surface which is extending at least above a top surface of one of said side walls and is curved to substantially conform to the shape of the bottles to be retained and transported;

said case bottom includes means for resting said case bottom on closures of bottles in a subjacent case and for aligning each closure with said case bottom for stacking said case.

48. A stackable low depth case for retaining and transporting bottles comprising:

a plurality of outer side walls, forming an outer shell having a low depth;

a case bottom disposed substantially within said outer shell; and a plurality of means, generally disposed within said outer shell and extending at least above a top surface of one of said side walls, for increasing the effective height of the case to thereby limit the tilting movement of the bottles to be retained and transported and defining, in combination with said case bottom and said outer shell, a plurality of bottle retaining pockets, with at least four adjacent effective case height increasing means per pocket;

said case bottom includes means for resting said case bottom on closures of bottles in a subjacent case and for aligning each closure with said case bottom for stacking said case.

49. A stackable low depth case as in claim 48, wherein said case bottom further comprises an upper surface which is substantially flat across the bottle retaining pockets.

50. A stackable low depth case as in claim 48, wherein each of said plurality of effective case height increasing means extend above the case bottom a distance approximately one-third of the height of the bottles to be retained and transported.

51. A stackable low depth case as in claim 48, wherein the plurality of effective case height increasing means extend upwardly from and contact said case bottom.

52. A stackable low depth case as in claim 48, wherein at least one of said effective case height increasing means includes a projecting portion extending above a topmost point of at least some of the other of said effective case height increasing means.

53. A stackable low depth case as in claim 48, wherein said outer shell is rectangular having a longer length than width and having the ratio of the length to the width of the outer shell be substantially equal to the ratio of the number of bottles said case holds in a lengthwise direction to the number of bottles said case holds in a widthwise direction; and at least one of said effective case height increasing means is disposed along a centerline of the length of the case and extending above at least a top surface of one of said side walls, said at least one effective case height increasing means disposed along a centerline of the length of the case includes a recess for receiving a side wall of an identical upper crate so that an identical upper crate can be cross-stacked with said case when said case is empty and the center-to-center distance between adjacent bottle retaining pockets within said case and between said case and the upper identical case are substantially equal.

54. A stackable low depth case as in claim 48, wherein at least one of said effective case height increasing means can be associated with more than one of said pockets.

55. A stackable low depth case for retaining and transporting bottles comprising:

a plurality of outer side walls, forming an outer shell having a low depth;

a case bottom disposed substantially within said outer shell; and a plurality of columns, generally disposed within said outer shell, and extending at least above a top surface of one of said side walls with at least four adjacent columns defining, in combination with the outer shell and the case bottom, a plurality of bottle retaining pockets;

said case bottom includes means for resting said case bottom on closures of bottles in a subjacent case and for aligning each closure with said case bottom for stacking said case.

56. A stackable low depth approximately one-third height case for retaining and transporting 2-liter PET bottles comprising:

four outer side walls forming a rectangular outer shell having a low depth, having a longer length than width and having the ratio of the length to the width of the outer shell be substantially equal to the ratio of the number of 2-liter PET bottles said case holds in a lengthwise direction to the number of 2-liter PET bottles said case holds in a widthwise direction;

a case bottom disposed substantially within said outer shell; and a plurality of columns generally disposed within said outer shell and including 2-liter PET bottle supporting surfaces, said 2-liter PET bottle supporting surfaces defining, in combination with said outer shell and said case bottom, a plurality of 2-liter PET bottle retaining pockets;

said case bottom includes:

an upper surface which is substantially flat across the bottle retaining pockets; and a lower surface including means for resting the case bottom on closures of 2-liter PET bottles in a subjacent case and for aligning each closure with said case bottom for stacking said case;

wherein said plurality of columns extend above said lower surface of said case bottom a distance of approximately one-third of the height of the 2-liter PET bottles to be retained and transported.

57. A stackable low depth approximately one-third height case as in claim 56, wherein said plurality of columns extend approximately four inches above said lower surface of said case bottom.

58. A stackable low depth approximately one-third height case as in claim 56, wherein at least one of said columns includes a projecting portion extending above at least one of side walls and a topmost point of at least some of the other of said columns.

59. A stackable low depth approximately one-third height case as in claim 57, wherein at least one of said columns can be associated with more than one of said pockets.

* * * * *

UNITED STATES PATENT AND TRADEMARK OFFICE

CERTIFICATE OF CORRECTION

PATENT NO. : 4,899,874

DATED : February 13, 1990

INVENTOR(S) : WILLIAM PATRICK APPS, JAMES B. REHRIG and JOHN A. HAGAN

It is certified that error appears in the above-identified patent and that said Letters Patent is hereby corrected as shown below:

ON TITLE PAGE: [75]Inventors Section, change "both" to --John A. Hagan, Fountain Valley, all--.

In claim 59, line 2, change "57" to --56--.

Signed and Sealed this

Twenty-seventh Day of August, 1991

*Attest:*

HARRY F. MANBECK, JR.

*Attesting Officer*

*Commissioner of Patents and Trademarks*